United States Patent [19]

Junk

[11] Patent Number: 4,919,338

[45] Date of Patent: Apr. 24, 1990

[54] EYEBALL ASSEMBLY FOR AN EYEBALL FITTING

[75] Inventor: Richard A. Junk, Elkhorn, Wis.

[73] Assignee: Sta-Rite Industries, Milwaukee, Wis.

[21] Appl. No.: 301,326

[22] Filed: Jan. 24, 1989

[51] Int. Cl.[5] ..... B05B 15/08

[52] U.S. Cl. ..... 239/587; 239/591

[58] Field of Search ..... 239/587, 591, 600, 390, 239/391, 396; 4/492, 541, 542

[56] References Cited

U.S. PATENT DOCUMENTS

| | | | |
|---|---|---|---|
| 2,936,580 | 5/1960 | Lauzely et al. | 239/587 X |
| 3,391,870 | 7/1968 | Nash . | |
| 4,168,033 | 9/1979 | von Bernuth et al. | 239/591 X |
| 4,219,161 | 8/1980 | Freissle | 239/600 X |
| 4,520,514 | 6/1985 | Johnson | 4/490 |
| 4,635,850 | 1/1987 | Leisi | 239/600 X |
| 4,717,078 | 1/1988 | Arp | 239/550 |

OTHER PUBLICATIONS

GC Pool Equipment Advertisement.

Drawing—Illustrating the Prior Art Eyeball Assembly Construction Discussed on p. 2 of this Application.

*Primary Examiner*—Andres Kashnikow

*Assistant Examiner*—Kevin P. Weldon

*Attorney, Agent, or Firm*—Andrus, Sceales, Starke & Sawall

[57] ABSTRACT

An eyeball assembly for use in an eyeball fitting. The eyeball assembly includes a passage for allowing water flow therethrough, and the passage is adapted to accept an insert for adjusting the discharge orifice of the eyeball or governing the direction of discharge therefrom. Various inserts are adapted for placement within the eyeball passage. The eyeball passage is configured so as to provide an area of minimum transverse dimension, and the inserts are configured so as to provide an end which has a transverse dimension slightly greater than the minimum eyeball passage dimension. The inserts are adapted to be engaged within the eyeball passage by means of a push-on force substantially parallel to the longitudinal axis of the eyeball passage, causing the inserts to "snap" within the eyeball passage to provide a secure engagement therebetween. The inserts are difficult to remove by manual force, but, with the aid of a tool, can be removed from the eyeball for replacement or interchangeability.

14 Claims, 2 Drawing Sheets

EYEBALL ASSEMBLY FOR AN EYEBALL FITTING

BACKGROUND AND SUMMARY

The present invention relates to an eyeball fitting for use in a swimming pool water supply line or the like, and more particularly to an improved eyeball assembly for use in an eyeball fitting.

Eyeball fittings are commonly employed in a swimming pool water supply line, and typically include an eyeball having a substantially spherical outer surface. The eyeball is retained within a seat having a substantially spherical inner surface to receive the spherical outer surface of the eyeball. A passage is formed through the eyeball so that water passes from the supply line into the swimming pool, and the eyeball can be positioned at various angular orientations relative to the supply line for discharging water into the swimming pool at a selected angle of discharge.

It has been found desirable to market eyeball fittings including an eyeball which is capable of receiving various inserts within the passage formed therethrough. The inserts typically provide a discharge outlet having a reduced diameter relative to the inlet of the eyeball fitting, providing a reduction orifice for discharging a proper flow rate of water into the swimming pool as required for operating conditions. For example, common practice is to provide one insert having a discharge orifice of ¾ inch diameter, another insert having a discharge orifice of ½ inch, and a right angle insert having a discharge orifice which is oriented substantially parallel to the longitudinal axis of the eyeball passage.

A number of prior art structures are known for providing straight through discharge of water through an eyeball. In one known structure, a series of "nesting" inserts are supplied with the eyeball fitting for providing a properly dimensioned discharge orifice. When a ¾ inch discharge orifice is desired, the insert having a discharge orifice of this diameter is installed in the eyeball. If a ½ inch discharge orifice is desired, the insert having a discharge orifice of this diameter is "nested" into the ¾ inch discharge orifice insert. If further reduction is required, such as a 3/16 inch discharge orifice, the insert having a discharge orifice of this diameter is "nested" into the ½ inch discharge orifice insert.

Another prior art structure for providing reducing orifices employs an eyeball having a relatively large diameter passage, with a lip formed at one end thereof. A series of orifice plates or discs are provided, each having a discharge orifice of a given diameter. The plates are adapted for placement within the eyeball passage against the lip, and are selectively replaceable one with another for providing a discharge orifice of a given diameter.

It has been found that the above-mentioned prior art eyeball structures are disadvantageous for a number of reasons. For example, it is possible for a swimmer to remove the reducing orifice inserts, which can upset the balance of water supply to the swimming pool. Further, with the "nesting" construction described above, a number of inserts may be necessary in order to achieve the ultimate desired dimension of the discharge orifice.

The present invention is intended to provide an eyeball assembly which eliminates or alleviates the above-noted problems, and provides an eyeball assembly of simple and secure construction. In accordance with the invention, an eyeball assembly for use in an eyeball fitting includes an eyeball having a substantially spherical outer surface. An axial passage extends through the eyeball, and is defined by first and second oppositely slanted tapered surfaces, forming a minimum transverse dimension of the eyeball passage between the first and second tapered surfaces. An insert is adapted for placement within the eyeball passage, and has a passage therethrough for allowing water to pass through the eyeball. The insert includes an outer wall defined at least in part by first and second oppositely slanted tapered surfaces, forming a minimum transverse dimension of the outer wall therebetween. One of the first and second tapered surfaces terminates at an end of the insert, which provides an outer transverse dimension to the end of the insert which is slightly greater than the minimum transverse dimension of the axial passage through the eyeball. The insert is adapted for push-on engagement with the eyeball by placement of the insert within the eyeball passage and forcing the end of the insert through the area of minimum transverse dimension of the eyeball passage, so as to securely engage the insert therewithin.

BRIEF DESCRIPTION OF THE DRAWINGS

The drawings illustrate the best mode presently contemplated of carrying out the invention.

In the drawings.

DETAILED DESCRIPTION OF THE PRIOR ART

Figure 1:
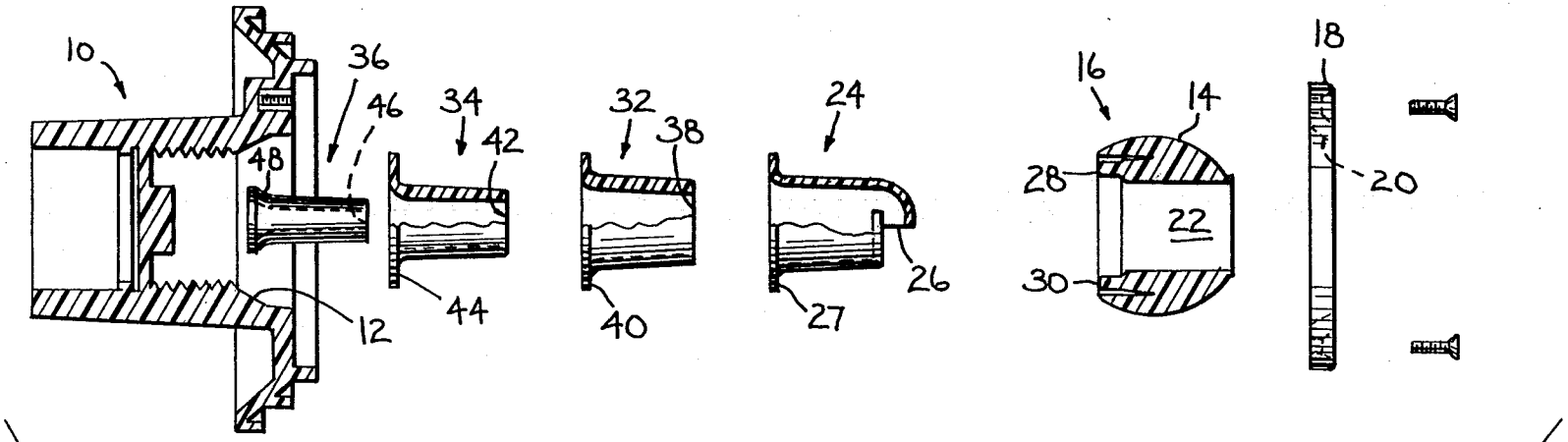
FIG. 1 PRIOR ART
FIG. 1 is an exploded elevation view showing a prior art eyeball fitting incorporating an eyeball and a series of prior art nesting type inserts for use therewith.

With reference to FIG. 1, a prior art eyeball fitting includes a body 10 adapted to receive the end of a water supply line at its leftward end. Body 10 includes a substantially spherical inner seat 12 adapted to receive a substantially spherical outer surface 14 of an eyeball 16. A face plate 18, including a substantially spherical inner surface 20, is adapted for connection to the rightward end of body 10 so as to fix eyeball 16 thereto, while allowing eyeball 16 to be positioned at variable angular orientations.

Eyeball 16 includes an axially extending inner passage 22, which allows water flow through eyeball 16. A right angle discharge insert 24 is provided for placement within eyeball passage 22, and includes a right angle discharge orifice 26. Right angle discharge insert 24 includes a rear flange 27, which is provided with at least a pair of openings which mate with a pair of projections 28, 30 located at the rear end of eyeball 16, for affixing right angle insert 24 thereto. When right angle insert 24 is positioned within eyeball passage 22, water flowing through eyeball 16 is discharged downwardly into the swimming pool through orifice 26.

When it is desired to provide a straight through discharge of water from eyeball 16 through an orifice substantially perpendicular to the axis of eyeball passage 22, inserts 32, 34 and/or 36 are employed. Insert 32, for example, provides a discharge outlet 38 having a diameter of ¾ inch, and includes a rear flange 40 which has openings adapted to receive projections 28, 30 on eyeball 16. When it is desired to further reduce the area of the discharge orifice, insert 34 is employed which has, for example, a discharge orifice 42 having a diameter of ½ inch. Insert 34 is constructed so as to "nest" within the passage through insert 32. Insert 34 includes a rear flange 44 which has openings adapted to receive projections 28, 30 on eyeball 16. If further reduction is required, insert 36 is placed within the passage through insert 34, as installed on eyeball 16. Insert 36 includes a discharge orifice 46 having a diameter, for example, of 3/16 inch. Insert 36 includes an expanded rear portion 48 which is adapted to mate with the rearward portion of the inner wall forming the passage through insert 34 for retaining insert 36 therein.

DETAILED DESCRIPTION OF THE PREFERRED EMBODIMENT

Figure 2:
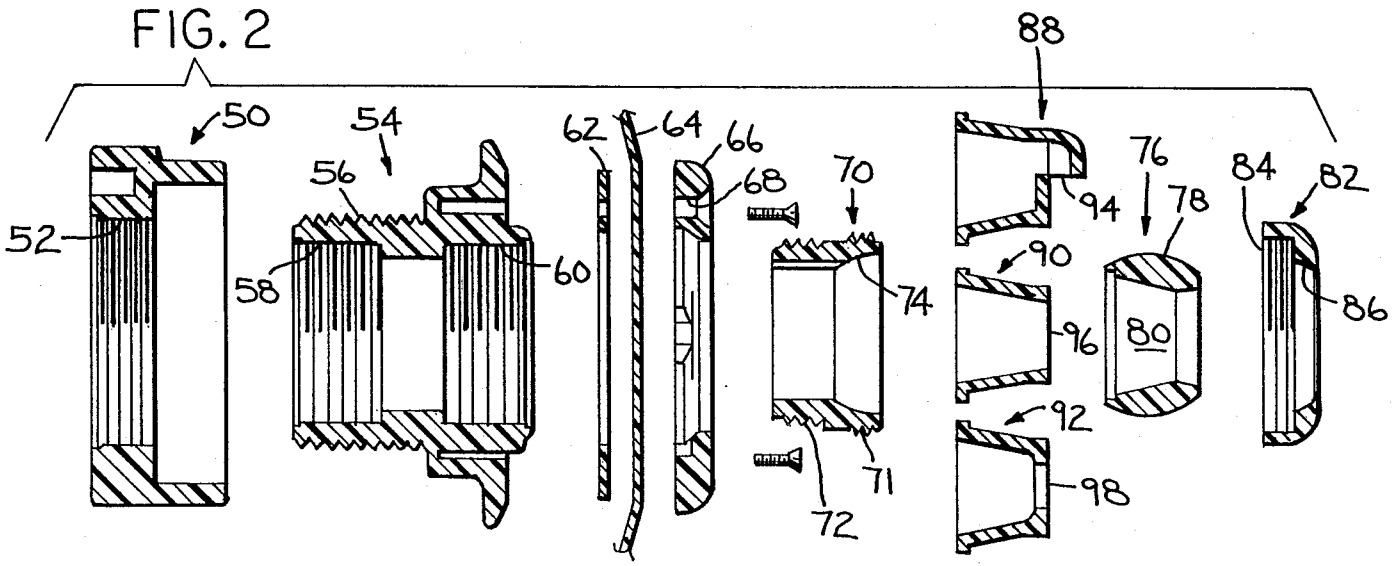
FIG. 2 is a view similar to FIG. 1 showing an eyeball fitting assembly incorporating an eyeball and inserts constructed according to the invention.

With reference to FIG. 2, an eyeball fitting constructed according to the invention is shown. The eyeball fitting includes a nut 50 for placement within the swimming pool wall and having a series of internal threads 52. A body portion 54 is provided at its rearward end with external threads 56 for threadedly engaging internal threads 52 on nut 50, and a series of internal threads 58 for receiving the end of a water supply line. Body portion 54 is provided at its forward end with a series of internal threads 60. Gasket 62 is adapted for placement adjacent the forward end of body portion 54, inwardly of a vinyl pool liner 64. An outer face plate 66 is adapted for placement on the outer surface of vinyl pool liner 64. Outer face plate 66 includes a series of passages, such as 68, adapted to receive a threaded fastener such as a screw or the like, for affixing outer face plate 66, vinyl liner 64 and inner face plate 62 to eyeball fitting body portion 54. A nipple 70 is provided at its forward end with external threads 71, and at its rearward end with external threads 72 which are adapted to engage internal threads 60 provided at the forward end of body portion 54. Nipple 70 is provided at its forward end with a curved inner surface 74 forming a partially spherical internal seat.

An eyeball 76, including a substantially spherical outer surface 78, is adapted for positioning into spherical seat 74 provided on nipple 70. Eyeball 76 includes a passage 80 for allowing water flow therethrough. A retaining ring 82 includes a series of internal threads 84 for engaging external threads 71 provided at the forward end of nipple 70. Retaining ring 82 has a curved inner surface 86 for engaging spherical outer surface 78 of eyeball 76 and retaining eyeball 76 in position.

One of a series of inserts, shown at 88, 90 and 92, are adapted for placement within passage 80 through eyeball 76 for restriction of the flow rate and direction of water discharge therefrom. Right angle insert 88 includes a right angle discharge orifice 94 for discharging water from eyeball 76 in a direction substantially perpendicular to the axis of passage 80. As shown, right angle insert 88 provides a reducing orifice, in that the area of discharge provided by orifice 94 is less than the inlet area of insert 88. Insert 90 is a straight through type insert, providing a discharge orifice 96 oriented substantially perpendicular to the axis of eyeball passage 80. For example, discharge orifice 96 may have a diameter of approximately ¾ inch. Insert 90 is also a reducing orifice, in that discharge orifice 96 provides an area of discharge less than the inlet area of insert 90. Insert 92 is similar to insert 90, but provides a discharge orifice 98 having a dimension less than that of discharge orifice 96. For example, discharge orifice 98 may be a ½ inch orifice.

According to the invention, one of inserts 88, 90 or 92 is positioned within eyeball passage 80, according to water supply needs at the particular point in the swimming pool at which the eyeball fitting is located.

Figure 3:
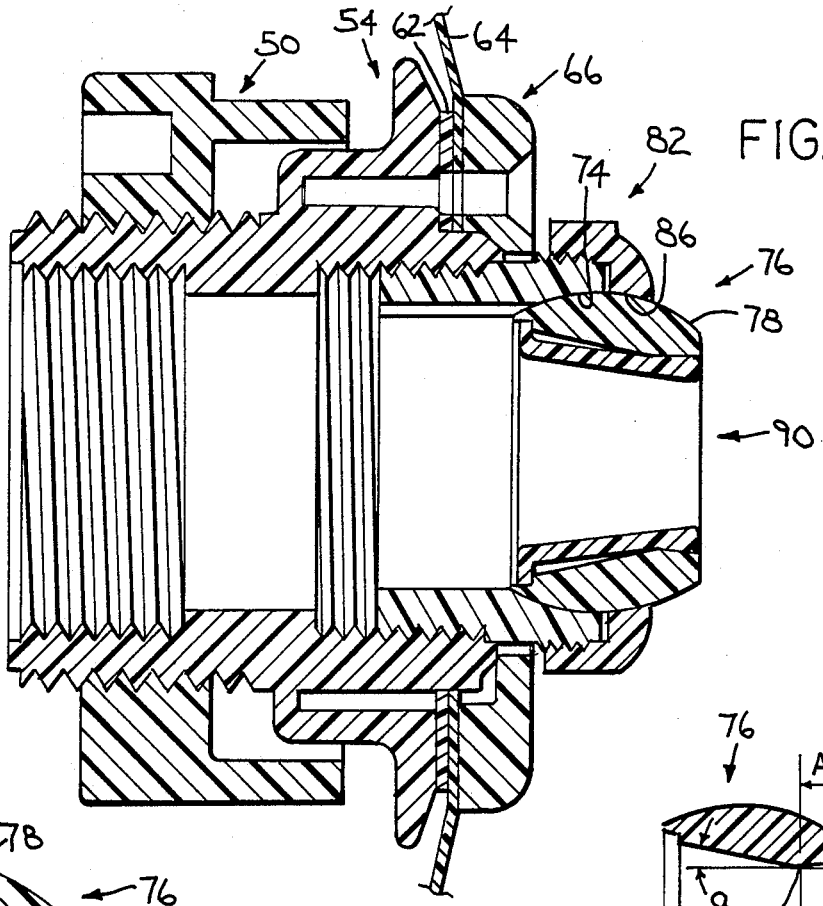
FIG. 3 is a sectional view of the eyeball assembly of FIG. 2 as assembled.
Figure 4:
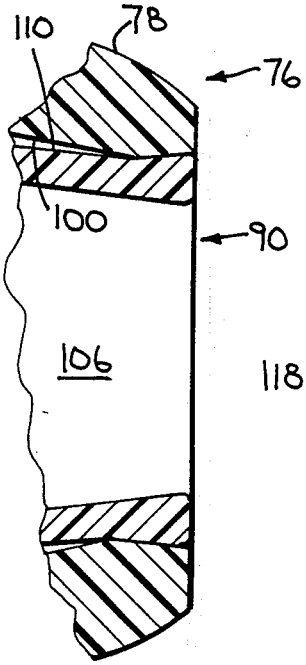
FIG. 4 is a partial enlarged sectional view of the eyeball and insert of FIG. 3, showing the interlocking of the insert as placed within the eyeball passage.

With reference to FIG. 3, the eyeball fitting shown in exploded fashion in FIG. 2 is shown assembled. As seen, spherical inner surface 74 of nipple 70 and spherical inner surface 86 of retaining ring 82 cooperate to capture or retain eyeball 76 at the end of the eyeball fitting. With this construction, the spherical inner surfaces and spherical outer surface 78 of eyeball 76 allow eyeball 76 to be positioned at various angular orientations so as to control the direction of water discharge therefrom.

Reference is now made to FIGS. 4–7, which illustrate in detail the interconnection of inserts 88, 90 and 92 with eyeball 76. While the interconnection of insert 90 and eyeball 76 is described in detail, it is understood that inserts 88 and 92 are constructed similarly to insert 90 for providing a similar interconnection with eyeball 76.

Figure 5:
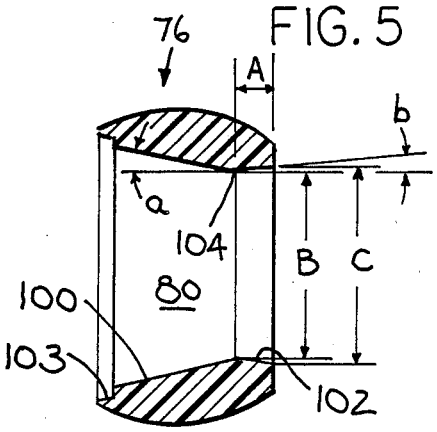
FIG. 5 is a sectional view of the eyeball shown in FIGS. 2, 3 and 4.

With reference to FIG. 5, eyeball passage 80 is formed by a first tapered inner surface 100 and a second tapered inner surface 102. A recess 103 is provided at the rearward end of eyeball passage 80. First and second tapered inner surfaces 100, 102 are oppositely oriented relative to the longitudinal axis of eyeball passage 80, so as to form an area of minimum transverse dimension, shown at 104, of eyeball passage 80 therebetween.

For purposes of illustration, it has been found that the following dimensions are satisfactory for passage 80. Dimension A, which is the length of tapered surface 102, is 0.20 inches. Dimension B, the minimum diameter of passage 80, is 0.970 inches, and dimension C, the diameter of passage 80 at its discharge end, is 1.000 inches. Angle a, the angle of taper of tapered surface 100, is approximately 12.4 degrees, and angle b, the angle of taper of tapered surface 102, is 4.0 degrees.

It is understood that the dimensions and angles noted above are simply representative, and that other dimensions and angles may provide a satisfactory structure.

Figure 6:
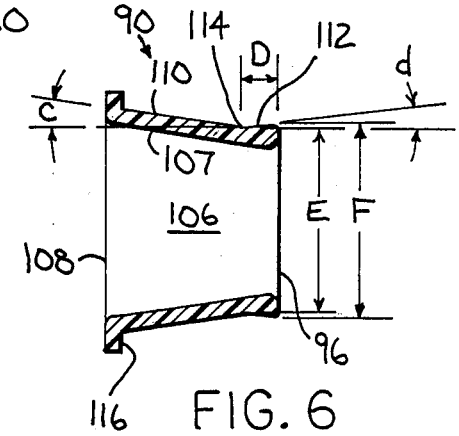
FIG. 6 is a sectional view of the insert shown in FIGS. 2, 3 and 4.

As shown in FIG. 6, insert 90 includes a passage 106 therethrough, terminating in discharge orifice 96. As shown in FIG. 3, insert 90 is adapted for placement within eyeball passage 80, for providing a discharge orifice of a desired diameter for water passing into the swimming pool. Insert passage 106 includes a water supply inlet 108 having a diameter greater than that of discharge orifice 96, which, as noted, may be ¾ inch. Insert passage 106 is formed by an inner wall 107, which provides a smooth flow path for water between supply inlet 108 and discharge orifice 91.

Insert 90 is substantially equal in length to eyeball passage 80, and includes an outer wall defined by a first tapered surface 110 and second tapered surface 112. Tapered surfaces 110, 112 are oppositely oriented relative to the longitudinal axis of insert 90, so as to form a minimum transverse diameter of the outer wall of insert 90, at 114.

For purposes of illustration, it has been found that the following dimensions are satisfactory for the outer wall of insert 90. Dimension D, which is the length of tapered surface 112, is 0.20 inches. Dimension E, the minimum diameter of the outer wall of insert 90, is 0.960 inches. Dimension F, which is the diameter of the outer wall of insert 90 at its discharge end, is 0.990 inches. Angle c, the angle of taper of tapered surface 110, is 8 degrees, and angle d, the angle of taper of tapered surface 112, is 5 degrees.

It is understood that the dimensions and angles noted above are simply representative, and that other dimensions and angles may provide a satisfactory structure.

With the construction of insert 90 as shown, it is seen that the outer dimension of insert 90 at its discharge end is slightly greater than minimum diameter 104 of eyeball passage 80. Insert 90 is adapted for placement within eyeball passage 80 by placing the discharge end of insert 90 into passage 80 until engagement of minimum diameter area 104 of passage 80 with the outer wall of the discharge end of insert 90. After such engagement, a force is applied to insert 90 in a direction parallel to the longitudinal axis of insert 90, which coincides with the longitudinal axis of eyeball passage 80, until insert tapered surface 112 snaps through minimum diameter area 104 of passage 80. Thereafter, the discharge end of eyeball 76 and insert 90 assume the position shown in FIG. 4, wherein the minimum diameter area 104 of passage 80 and the minimum diameter area 114 of the insert outer wall are adjacent each other. Insert tapered surface 112 engages eyeball tapered surface 102 for securely retaining insert 90 within eyeball passage 80.

Insert 90 includes a flange 116 formed at its rearward end, which is disposed within recess 103 provided at the rearward end of eyeball 76, as shown in FIG. 3.

Eyeball 76 and insert 90 are constructed of a plastic material, such as polyvinyl chloride, preferably such as that manufactured by the B. F. Goodrich Company under its designation Geon, Grade 85856. This material provides the necessary resilience for allowing insert tapered surface 112 to pass through minimum diameter area 104 of the eyeball passage 80, thereafter resuming its original position for retaining insert 90 therein. It is understood that any other satisfactory material may be used.

The described construction provides an eyeball assembly in which the insert is difficult to remove by a swimmer, but which can be removed if necessary for replacement or interchangeability with a different insert. The one-piece nature of the insert eliminates detrimental effects resulting from use of a "nesting" type arrangement.

Figure 7:
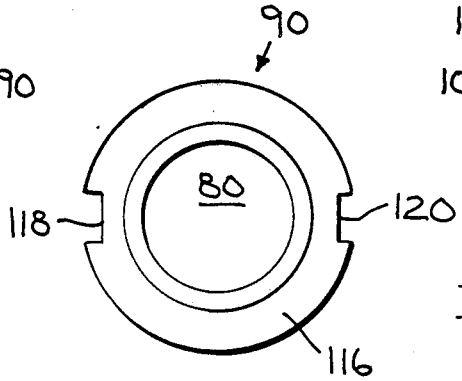
FIG. 7 is a rear elevation view of the insert of FIG. 6.

Rear flange 116 of insert 90 is provided with a pair of notches, shown in FIG. 7 at 118, 120. Notches 118, 120 provide an opening for receiving a tool to aid in the removal of insert 90 from eyeball 80, such by application of a prying action. It has been found that, without the aid of a tool in removal, insert 90 is difficult to manually remove from eyeball passage 80.

Various alternatives and modifications are contemplated as being within the scope of the following claims particularly pointing out and distinctly claiming the subject matter regarded as the invention.

I claim:

1. An eyeball assembly for use in an eyeball fitting, comprising:

an eyeball having a substantially spherical outer surface;

an axial passage extending through said eyeball and being defined at least in part by a first tapered surface and a second tapered surface, said first and second tapered surfaces being oppositely oriented relative to the axis of said passage so as to form a minimum transverse dimension of said passage at the juncture of said first and second tapered surfaces; and an axially extending insert adapted for placement within said eyeball passage, said insert including a passage therethrough having an inlet end and an outlet end, for allowing fluid to pass through said eyeball, said insert including an outer wall defined at least in part by a reducing tapered surface disposed toward said inlet end and a continuously expanding tapered surface disposed toward said outlet end, said reducing and expanding tapered surfaces being oppositely oriented relative to the axis of said insert so as to form a minimum transverse dimension of said outer wall therebetween, with said expanding tapered surface providing a transverse dimension to said insert outlet end slightly greater than the minimum transverse dimension of the axial passage through said eyeball;

said insert being adapted for push-on engagement with said eyeball by placement of said insert within the axial passage through said eyeball and forcing said outlet end of said insert through the minimum transverse dimension of said eyeball passage so as to securely engage said insert within said eyeball passage.

2. The eyeball assembly of claim 1, wherein said first tapered surface of said eyeball passage extends from one end of said eyeball to the minimum transverse dimension of said eyeball passage, and said second tapered surface of said eyeball passage extends from the other end of said eyeball to the minimum transverse dimension of said eyeball passage.

3. The eyeball assembly of claim 2, wherein said insert is dimensioned so as to extend substantially the entire length of said eyeball passage, and wherein said expanding and reducing tapered surfaces of said insert outer wall are substantially equal in length to said first and second tapered surfaces, respectively, of said eyeball passage.

4. The eyeball assembly of claim 1, wherein said insert passage includes an inlet having a first transverse dimension and an outlet having a second transverse dimension less than said first transverse dimension, so that said insert acts as a reducer.

5. The eyeball assembly of claim 4, wherein the outlet of said insert passage lies in a plane substantially perpendicular to the axis of said insert.

6. The eyeball assembly of claim 4, wherein the outlet of said insert passage lies in a plane substantially parallel to the axis of said insert.

7. The eyeball assembly of claim 4, wherein said insert includes an outwardly extending flange formed at its outlet end, and wherein said eyeball passage includes a recess adapted to receive said insert flange.

8. An eyeball fitting for delivering water to a swimming pool, said eyeball fitting being disposed at the discharge end of a water supply line and having an inlet in communication with said water supply and an outlet in communication with said swimming pool, said eyeball fitting comprising:

an eyeball having a substantially spherical outer surface;

an axial passage extending through said eyeball, said axial passage being defined at least in part by a first tapered surface and a second tapered surface, said first and second tapered surfaces being oppositely oriented relative to the axis of said passage so as to form a minimum transverse dimension of said passage at the juncture of said first and second tapered surfaces;

an axially extending insert adapted for placement within said eyeball passage, said insert including a passage therethrough having an inlet end and an outlet end for allowing water to pass through said eyeball, said insert including an outer wall defined at least in part by a reducing tapered surface disposed toward said inlet end and continuously expanding tapered surface disposed toward said outlet end, said reducing and expanding tapered surfaces being oppositely oriented relative to the axis of said insert so as to form a minimum transverse dimension of said outer wall therebetween, with said expanding tapered surface providing a transverse dimension to said insert outlet end slightly greater than the minimum transverse dimension of the axial passage through said eyeball;

said insert being adapted for push-on engagement with said eyeball by placement of said insert within the axial passage through said eyeball and forcing said outlet end of said insert through the minimum transverse dimension of said eyeball passage so as to securely engage said insert within said eyeball passage; and retainer means adapted for placement at the end of said water supply line and including a substantially spherical inner surface for receiving said eyeball and cooperating with the substantially spherical outer surface of said eyeball for allowing said eyeball to be positioned at variable angular orientations.

9. An eyeball assembly for use in an eyeball fitting, comprising:

an eyeball having a substantially spherical outer surface;

an axial passage extending through said eyeball, said axial passage being defined by an inner wall including a reducing portion and an expanding portion, said inner wall including a surface of minimum transverse dimension disposed between said reducing portion and said expanding portion; and an axially extending insert adapted for placement within said eyeball passage, said insert including a passage therethrough having an inlet end and an outlet end for allowing fluid to pass through said eyeball, said insert including an outer wall defined at least in part by a continuously expanding surface extending between the outlet end of said insert and an area of minimum transverse dimension of said insert outer wall spaced from said outlet end of said insert, with said outlet end of said insert having an outer transverse dimension slightly greater than the minimum transverse dimension of said eyeball passage;

said insert being adapted for push-on engagement with said eyeball by placement of said insert within said eyeball passage and forcing said outlet end of said insert through the minimum transverse dimension of said eyeball passage so as to securely engage said insert within said eyeball passage.

10. The eyeball assembly of claim 9, wherein said eyeball passage reducing portion and said eyeball passage expanding portion are substantially contiguous, with said surface of minimum transverse dimension disposed therebetween.

11. The eyeball assembly of claim 9, wherein said continuously expanding surface of said insert outer wall is substantially equal in length to said expanding portion of said eyeball passage.

12. The eyeball assembly of claim 9, wherein the inlet end of said insert is provided with a flange, and wherein said eyeball includes a recess adapted to receive said flange when said insert is engaged within said eyeball passage.

13. The eyeball assembly of claim 12, wherein said flange includes one or more cut-out portions to aid in the removal of said insert from said eyeball.

14. The eyeball assembly of claim 9, wherein said insert extends throughout substantially the entire length of said eyeball passage.

* * * * *

UNITED STATES PATENT AND TRADEMARK OFFICE

CERTIFICATE OF CORRECTION

PATENT NO. : 4,919,338

DATED : 4/24/90

INVENTOR(S) : Richard A. Junk

It is certified that error appears in the above-identified patent and that said Letters Patent is hereby corrected as shown below:

Claim 8, Col. 7, Line 13, After "and" insert --- a ---.

Signed and Sealed this

Thirtieth Day of July, 1991

*Attest:*

*Attesting Officer*

HARRY F. MANBECK, JR.

*Commissioner of Patents and Trademarks*